US012808591B2

(12) United States Patent
Knatt

(10) Patent No.: US 12,808,591 B2
(45) Date of Patent: Nov. 24, 2026

(54) ICE MAKER WITH FLAMMABLE REFRIGERANT LEAK RESPONSE SYSTEM AND METHOD OF RESPONDING TO FLAMMABLE REFRIGERANT LEAK IN ICE MAKER

(71) Applicant: True Manufacturing Co., Inc., O'Fallon, MO (US)

(72) Inventor: Kevin D. Knatt, St. Louis, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 133 days.

(21) Appl. No.: 18/631,462

(22) Filed: Apr. 10, 2024

(65) Prior Publication Data

US 2024/0361059 A1 Oct. 31, 2024

Related U.S. Application Data

(60) Provisional application No. 63/498,981, filed on Apr. 28, 2023.

(51) Int. Cl.
*F25C 1/04* (2018.01)

(52) U.S. Cl.
CPC ..... *F25C 1/04* (2013.01); *F25C 2600/04* (2013.01); *F25C 2700/00* (2013.01)

(58) Field of Classification Search
CPC .... F25C 1/04; F25C 2600/04; F25C 2700/00; F25C 1/00; F25C 1/22; F25C 2400/10; F25C 2400/14; F25B 2500/222; F25B 49/005; F25B 49/02; F25B 9/002
See application file for complete search history.

(56) References Cited

U.S. PATENT DOCUMENTS 3,294,315 A * 12/1966 Stewart ..... F04D 29/388 416/213 A
2016/0334157 A1* 11/2016 Broadbent ..... F25C 5/20
(Continued)

FOREIGN PATENT DOCUMENTS

CN 1820172 B * 5/2010
CN 212902118 U * 4/2021
EP 2618079 B1 5/2016
(Continued)

OTHER PUBLICATIONS

Extended European Search Report from EP Application No. 24170106.9, dated Sep. 24, 2024, 7 pages.

*Primary Examiner* — Kun Kai Ma
(74) *Attorney, Agent, or Firm* — Stinson LLP

(57) ABSTRACT

An ice maker uses a compression-drive refrigeration system charged with flammable refrigerant to cool an ice formation device and a water system to supply water to the ice formation device. A control system operates the water system and the refrigeration system for cooling the ice formation device with the refrigeration system to form water supplied to the ice formation device by the water system into ice. A natural gas sensor detects natural gas and outputs a detection signal indicating detection of natural gas. A controller is connected to the natural gas sensor for receiving the detection signal. The controller outputs a response signal in response to receiving the detection signal. The response signal is operative to initiate a gas leak response action.

16 Claims, 6 Drawing Sheets

(56) References Cited

U.S. PATENT DOCUMENTS

| | | | | |
|---|---|---|---|---|
| 2017/0370628 | A1* | 12/2017 | Knatt | F25C 1/25 |
| 2021/0310713 | A1* | 10/2021 | Bishop | A61L 2/26 |

FOREIGN PATENT DOCUMENTS

| | | | | |
|---|---|---|---|---|
| JP | H01261676 | A | * | 10/1989 |
| JP | 2003121032 | A | * | 4/2003 |
| JP | 2005030651 | A | * | 2/2005 |
| JP | 2012225616 | A | * | 11/2012 |
| JP | 2022122186 | A | * | 8/2022 |
| WO | 2020014279 | A1 | | 1/2020 |

* cited by examiner

ICE MAKER WITH FLAMMABLE REFRIGERANT LEAK RESPONSE SYSTEM AND METHOD OF RESPONDING TO FLAMMABLE REFRIGERANT LEAK IN ICE MAKER

CROSS-REFERENCE TO RELATED APPLICATIONS

This application claims priority to U.S. Provisional Patent Application No. 63/498,981, filed Apr. 28, 2023, which is hereby incorporated by reference in its entirety for all purposes.

FIELD

This disclosure generally pertains to ice maker appliances of the type comprising a compression-driven refrigeration system in direct thermal contact with an ice formation device. More particularly, this disclosure pertains to such ice makers wherein the refrigeration system is charged with flammable refrigerant such as propane.

BACKGROUND

Historically, refrigeration appliances including ice makers have been charged with hydrofluorocarbon (HFC) refrigerants, e.g., Freon. But HFCs are known to have high Global Warming Potential (GWP), so the industry has a longstanding interest in switching to more environmentally friendly natural refrigerants like propane (r290). Some natural refrigerants, e.g., propane, are highly flammable. Regulatory authorities have imposed strict charge limits to mitigate against fires and explosions. Recently, some regulatory authorities have begun to consider relaxing the charge limits on flammable refrigerants.

SUMMARY

In one aspect, an ice maker comprises a cabinet having an interior and an exterior. An ice formation device is received in the cabinet. A refrigeration system is at least partially received in the cabinet for cooling the ice formation device. The refrigeration system comprises a compression-drive refrigeration system charged with flammable refrigerant. A water system is at least partially received in the cabinet for supplying water to the ice formation device. A control system operates the water system and the refrigeration system for cooling the ice formation device with the refrigeration system to form water supplied to the ice formation device by the water system into ice. The control system comprises a natural gas sensor in the cabinet configured to detect natural gas and output a detection signal indicating detection of natural gas. A controller is connected to the natural gas sensor for receiving the detection signal. The controller is configured to output a response signal in response to receiving the detection signal. The response signal is operative to initiate a gas leak response action.

Other aspects and features will be apparent hereinafter.

BRIEF DESCRIPTION OF THE DRAWINGS

Corresponding parts are given corresponding reference characters throughout the drawings.

DETAILED DESCRIPTION

Figure 1:
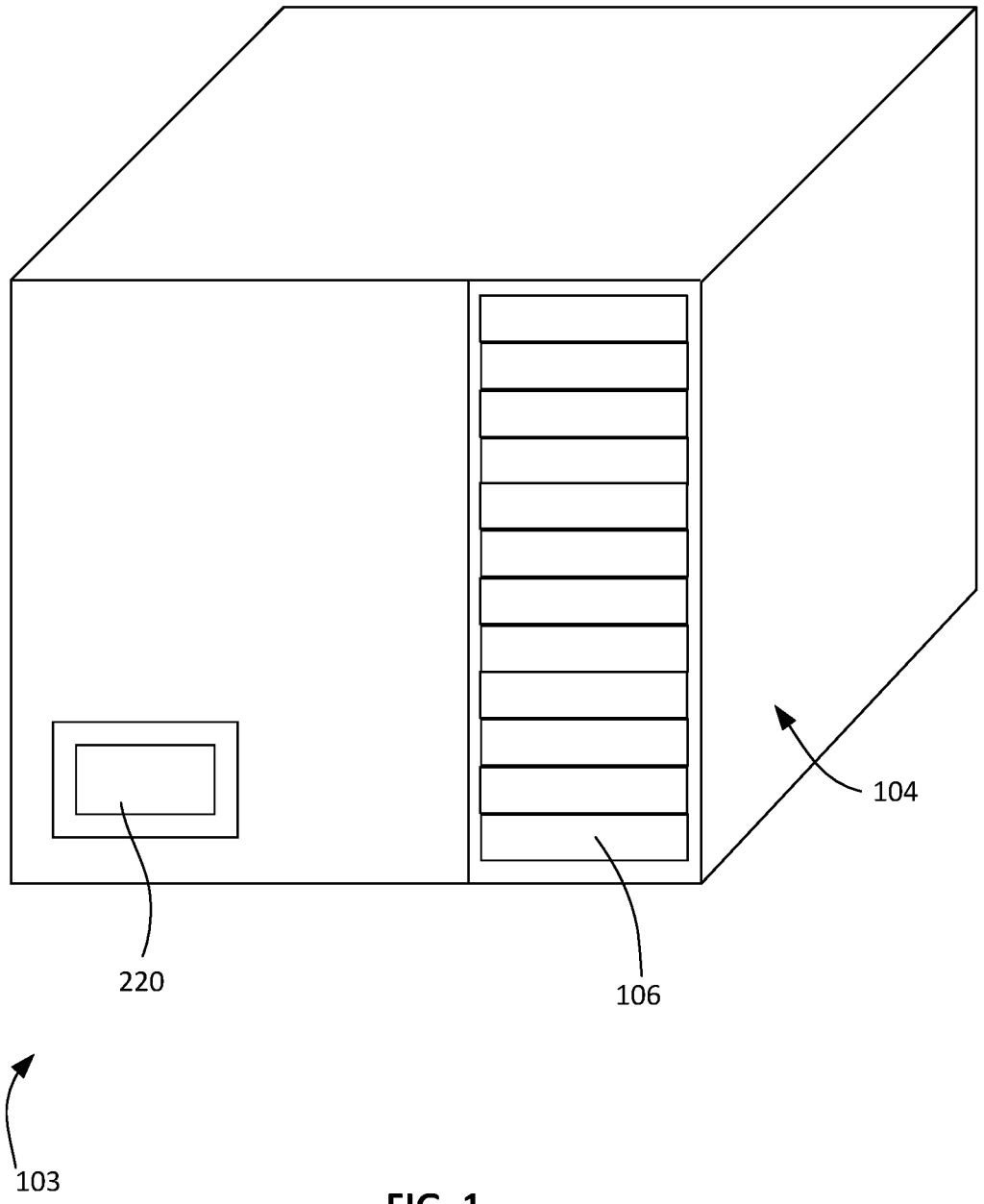
FIG. 1 is a perspective of an ice maker in accordance with the present disclosure.
Figure 2:
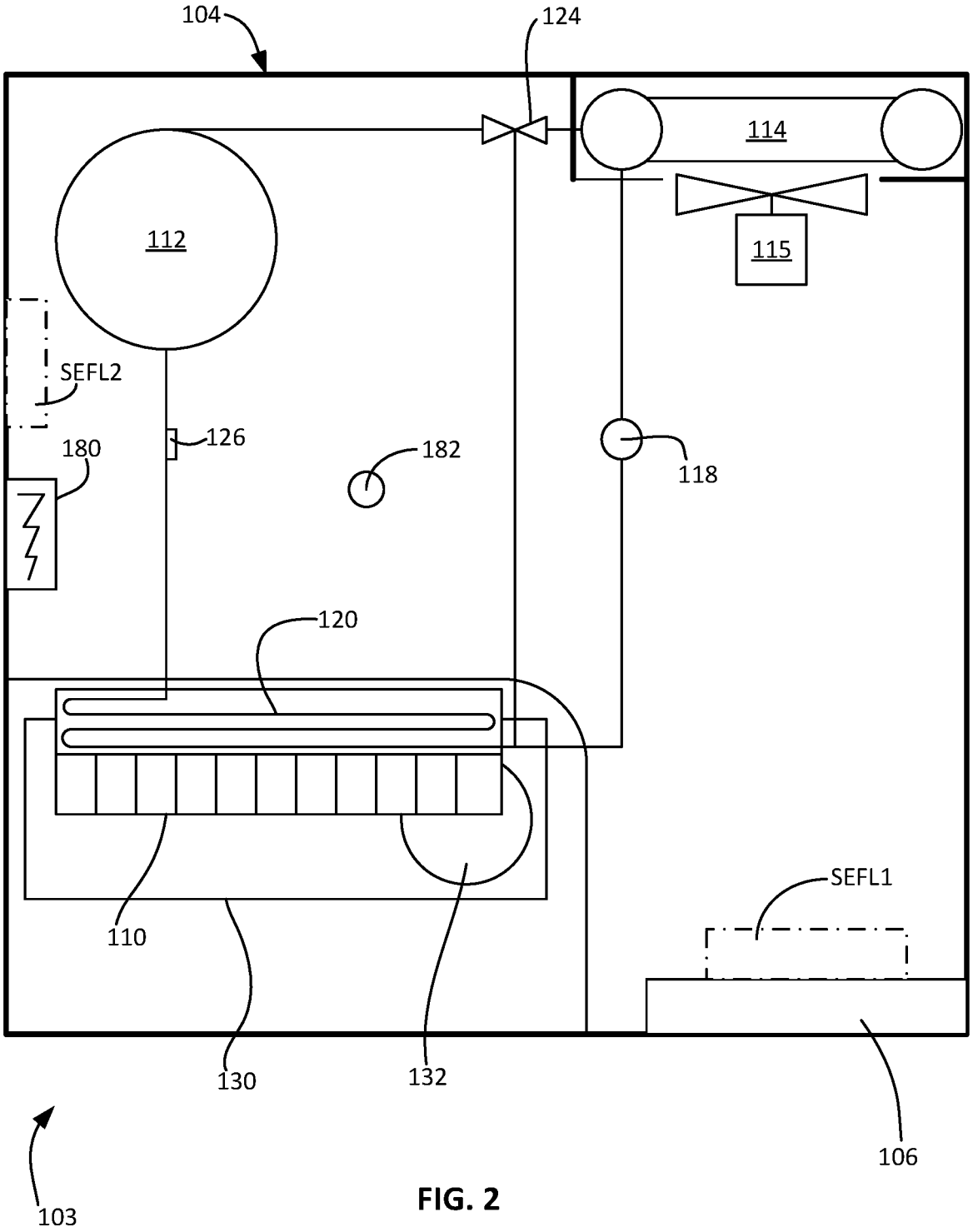
FIG. 2 is a schematic top plan view of the ice maker.
Figure 3:
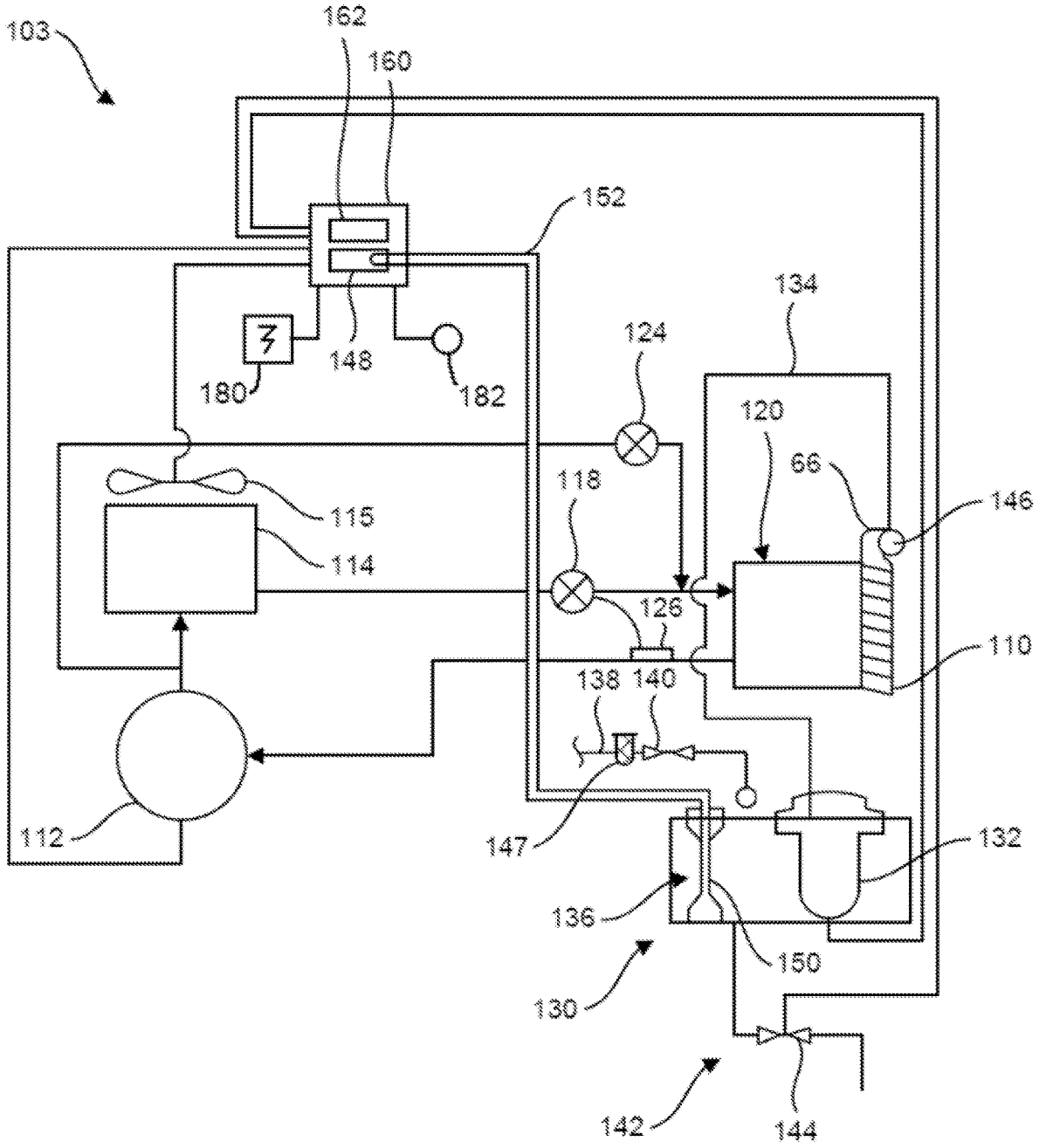
FIG. 3 is a schematic illustration of the refrigeration system and water system of the ice maker, as well certain components of a control system thereof.

Referring to FIGS. 1-3, an exemplary embodiment of an ice maker is generally indicated at reference number 103. Ice makers in the scope of this disclosure are standalone ice making appliances comprising a cabinet 104 in which ice making equipment is held. Suitably, the interior of the ice maker cabinet is at least partially open to the exterior of the cabinet (e.g., through a grill 106). The lack of a sealed-off interior space containing refrigeration differentiates the ice maker 103 from other types of refrigeration appliances like refrigerators and freezers. In the illustrated embodiment, the cabinet 104 is for an ice making head of the type that can be installed on top of a separate ice bin. In other embodiments of ice makers in the scope of this disclosure, the ice bin is incorporated into the cabinet.

Ice makers in the scope of this disclosure broadly comprise an ice formation device on which water can form into pieces of ice, a water system for directing water onto the ice formation device, and a refrigeration system configured to directly cool the ice formation device to a temperature at which at least some of the liquid water present on the ice formation device will freeze into ice. The ice formation device and at least certain portions of the water system and refrigeration system are contained in the cabinet 104. Ice makers in the scope of this disclosure are charged with flammable refrigerant such as r290 propane. As will be described in further detail below, the ice maker 103 comprises a refrigerant leak response system that is configured to detect a refrigerant leak and take automated action to address the leak, thereby mitigating against fire and explosion. The leak response system enables the refrigeration system to be charged with greater amounts of flammable refrigerants (e.g., more than 150 g r290, such has in an inclusive range of from 200 g r290 to 500 g r290). This disclosure first provides a general overview of the ice maker 103, before describing the refrigerant leak response system in greater detail.

In the illustrated embodiment, the ice maker is a batch ice maker of the type which has a generally vertically oriented freeze plate 110 that constitutes the ice formation device. Other types of ice makers such as nugget ice makers and vertical spray ice makers are also contemplated to be in the scope of this disclosure. In a nugget ice maker, the ice formation device is typically a chilled cylinder coupled to an auger that drives ice along the cylinder; and in a vertical spray ice maker, the ice formation device is typically a horizontally oriented freeze plate including ice piece molds that open downward for receiving vertically sprayed water that forms into ice in the molds.

The refrigeration system of the ice maker 103 includes a compressor 112, a condenser 114 (broadly, a heat rejecting heat exchanger), a refrigerant expansion device 118 for lowering the temperature and pressure of the refrigerant, an evaporator 120 along the back side of the freeze plate 110, and a hot gas valve 124. The compressor 112 can be a fixed speed compressor or a variable speed compressor to provide a broader range of operational control possibilities. The compressor 112 cycles a flammable refrigerant (e.g., r290 propane) through the condenser 114, expansion device 118, evaporator 120, and the hot gas valve 124, via refrigerant lines.

In the illustrated embodiment, the heat rejecting heat exchanger 114 is a condenser for condensing compressed flammable refrigerant vapor discharged from the compressor 112. In other embodiments, the heat rejecting heat exchanger is able to reject heat from the refrigerant without condensing the refrigerant. In FIG. 2, the condenser 114 is schematically illustrated as a microchannel heat exchanger of the type comprising two opposing header tubes and an array of microchannel elements running between the header tubes. However, it will be understood that any suitable type of condenser can be used without departing from the scope of the disclosure.

In the illustrated embodiment, the condenser 114 is configured to be air cooled. The condenser 114 is situated between a grill 106 of the cabinet 104 and an opening in the back wall 107 of the cabinet. The opening in the back wall of the cabinet 104 forms the inlet to the condenser 114. In one or more embodiments the opening is covered by a filter (not shown). In other embodiments, the condenser 114 can be located between a side grill and an opening in the back wall of the cabinet or in any other location that allows for heat exchange between the condenser 114 and outside air. In the illustrated embodiment, the refrigeration system comprises a condenser fan 115 situated between the condenser 114 and the grill 106. When activated during refrigeration, the condenser fan 115 operates in a forward direction to draw outside air through the condenser 114. The condenser 114 rejects heat from the flammable refrigerant into the outside air stream, and the warm air is discharged from the cabinet 104 through the grill 106. In an exemplary embodiment, the condenser fan 115 is a non-sparking fan including a non-sparking fan motor so it can be operated even when there are elevated concentrations of flammable natural gas inside the cabinet 104. In certain embodiments, the condenser fan 115 is a variable speed fan having a plurality of speed settings, including at least a normal speed and a high speed. In certain embodiments, the condenser fan can be periodically operated in reverse to blow dust and debris off of the condenser, thereby cleaning the condenser for more efficient operation.

Hot gas valve 124 is configured to be selectively opened so that the compressed refrigerant from the compressor 112 bypasses the condenser 114 and directs the warm refrigerant directly to the evaporator 120. As is known to those skilled in the art, the hot gas valve 124 is used during harvest cycles to warm the freeze plate 110 so the ice contained therein melts and falls out of the freeze plate into an ice bin (not shown).

The refrigerant expansion device 118 can be of any suitable type, including a capillary tube, a thermostatic expansion valve, or an electronic expansion valve. In certain embodiments, where the refrigerant expansion device 118 is a thermostatic expansion valve or an electronic expansion valve, the ice maker 110 may also include a temperature sensor 126 placed at the outlet of the evaporator 120 to control the refrigerant expansion device 118. In other embodiments, where the refrigerant expansion device 118 is an electronic expansion valve, the ice maker 110 may also include a pressure transducer (not shown) placed at the outlet of the evaporator 120 to control the refrigerant expansion device 118 as is known in the art.

The water system of the illustrated ice maker 10 includes a sump 130, a water pump 132, a water line 134 (broadly, passaging), and a water level sensor 136. The water pump 132 could be a fixed speed pump or a variable speed pump to provide a broader range of control possibilities. The water system of the ice maker 103 further includes a water supply line 138 and a water inlet valve 140 for filling the sump 130 with water from a water source (e.g., a municipal water utility). The illustrated water system further includes a drain line 142 (also called, drain passaging or a discharge line) and a drain valve 144 (e.g., purge valve, drain valve; broadly, a purge device) disposed thereon for draining water from the sump 130. The sump 130 may be positioned below the freeze plate 110 to catch water coming off of the freeze plate such that the relatively cool water falling from the freeze plate may be recirculated by the water pump 132. The water line 134 fluidly connects the water pump 132 to a water distributor 146 above the freeze plate 110. During an ice batch production cycle, the pump 132 is configured to pump water through the water line 134 and through the distributor 146. The distributor is configured to distribute the evenly across the front of the freeze plate 110 so that the water flows downward along the freeze plate and either freezes as liquid or falls from the bottom of the freeze plate into the sump 130. In the illustrated embodiment, the water system further comprises a water filter 147 configured to filter the water imparted into the ice maker 103 for making ice.

In an exemplary embodiment, the water level sensor 136 comprises a remote air pressure transducer 148. It will be understood, however, that any type of water level sensor may be used in the ice maker 103 including, but not limited to, a float sensor, an acoustic sensor, or an electrical continuity sensor. The illustrated water level sensor 136 includes a fitting 150 that is configured to couple the sensor to the sump 130. The fitting 150 is fluidly connected to a pneumatic tube 152. The pneumatic tube 152 provides fluid communication between the fitting 150 and the air pressure transducer 148. Water in the sump 130 traps air in the fitting 150 and compresses the air by an amount that varies with the level of the water in the sump. Thus, the water level in the sump 130 can be determined using the pressure detected by the air pressure transducer 148. Additional details of exemplary embodiments of a water level sensor comprising a remote air pressure transducer are described in U.S. Patent Application Publication No. 2016/0054043, which is hereby incorporated by reference in its entirety.

An exemplary ice maker of the type shown in FIG. 1 is more fully described in U.S. patent application Ser. No. 17/147,965, entitled Ice Maker, filed Jan. 13, 2021, which is hereby incorporated by reference in its entirety.

Figure 4:
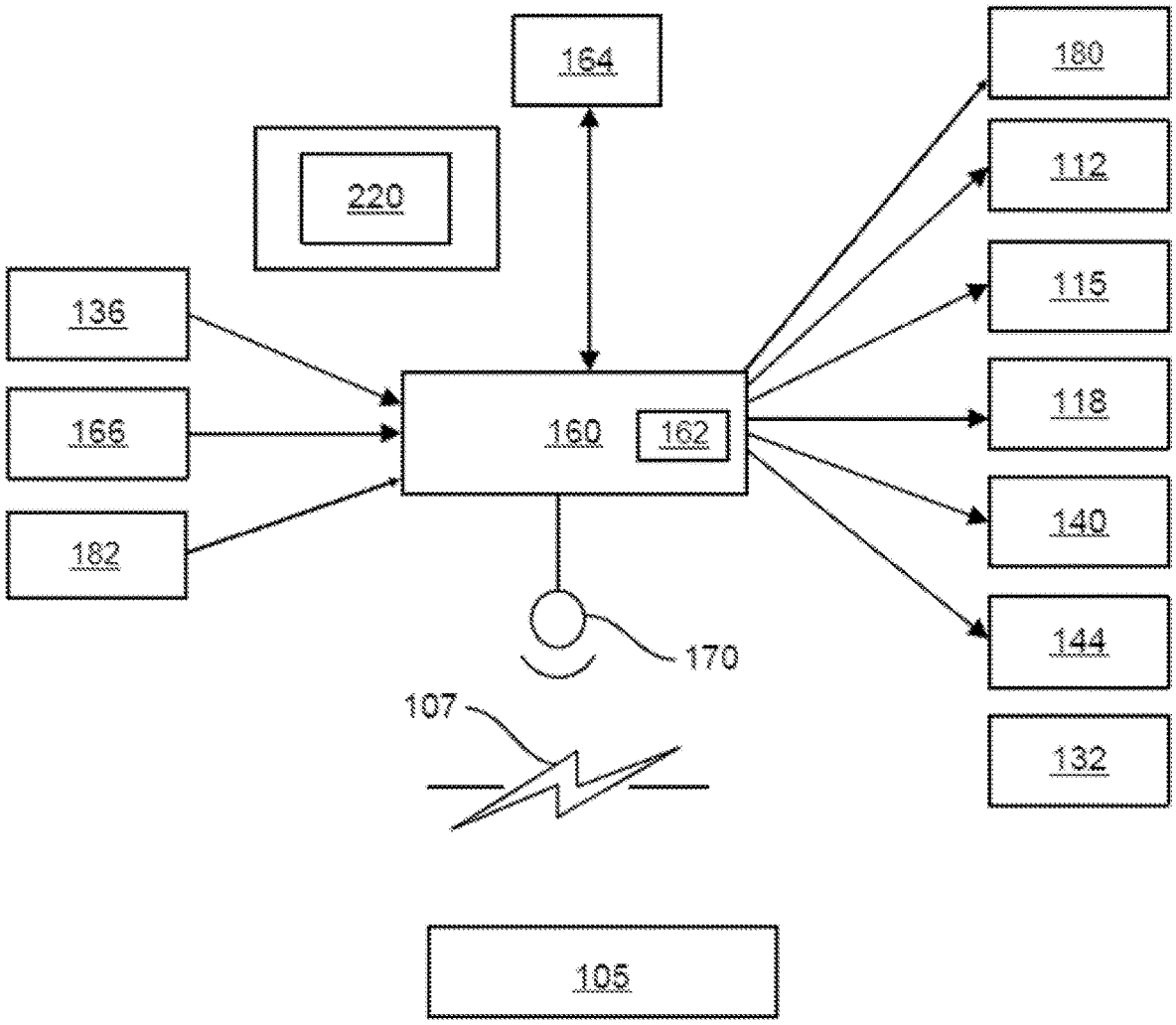

Referring to FIGS. 3 and 4, the ice maker 103 comprises a control system including a controller 160. The controller 160 includes at least one processor 162 for controlling the operation of the ice maker 103, e.g., for controlling at least one of the refrigeration system and the water system. The processor 162 of the controller 160 may include a non-transitory processor-readable medium storing code representing instructions to cause the processor to perform a process. The processor 162 may be, for example, a commercially available microprocessor, an application-specific integrated circuit (ASIC) or a combination of ASICS, which are designed to achieve one or more specific functions, or enable one or more specific devices or applications. In certain embodiments, the controller 160 may be an analog or digital circuit, or a combination of multiple circuits. The controller 160 may also include one or more memory components 164 for storing data in a form retrievable by the controller. The controller 160 can store data in or retrieve data from the one or more memory components 164.

In the illustrated embodiment, the control system further comprises a local user interface device 220 that includes a display (and/or another indicator such as a light panel or a speaker). For example, in one or more embodiments, the user interface device 220 comprises a local touch screen display that is mounted on the exterior of the ice maker 103. The controller 160 is connected to the user interface device 220 to receive user inputs to the interface device and to control the user interface device to display one or more display screens on the display.

The appliance control system further comprises a network interface 170 configured to connect the appliance 103 to a network 107 (e.g., the internet or an off-internet cellular sub-net) for communication with a remote asset management system 105. In other words, the network interface 170 is configured to provide communication between the local controller 160 of the appliance 103 and the remote asset management system 105. An exemplary embodiment of communications architecture for use in an asset management system for appliances is described in greater detail in U.S. Pat. No. 9,863,694, which is hereby incorporated by reference in its entirety. Another exemplary embodiment of communications architecture for use in an asset management system for appliances like the ice maker 102 is described in U.S. Provisional Patent Application No. 63/393,092, which is hereby incorporated by reference in its entirety. Additional information about the communications architecture is described in PCT/US23/29025, which is also hereby incorporated by reference in its entirety. The illustrated network interface 170 comprises a wireless transceiver such as a cellular data transceiver or a Wi-Fi transceiver. In certain embodiments, the network interface 170 can comprise a data system on a module (DSOM) of the type described in U.S. Pat. No. 11,537,631. Other types of network interfaces (e.g., hardwired internet ports, etc.) can also be used without departing from the scope of the disclosure. The network interface 170 is broadly configured to pass operating data (broadly, data objects) from the appliance 103 to the asset management system 105 and pass commands (broadly, data objects) from the asset management system to the appliance. An exemplary asset management system for performing maintenance compliance tasks is described more fully in U.S. patent application Ser. No. 17/686,986, filed Mar. 4, 2022, entitled Systems and Methods for Monitoring Refrigeration Appliances, which is hereby incorporated by reference in its entirety.

The system 105 can be a comprise a cloud server system for hosting cloud applications. Accordingly, in one or more embodiments, the asset management software is a cloud-based software platform. Among other things, the cloud-based software can maintain a database of push notification contact information (e.g., cell phone number and/or email address) for each ice maker 103 connected to the asset management system 105. In certain embodiments, the cloud software is configured automatically push certain notifications to the operator using the stored push notification contact information.

The ice maker control system further comprises hygiene and safety subsystems. In the illustrated embodiment, these subsystems include an ice maker disinfection device 180. Various ice maker disinfection devices are known to those skilled in the art. For example, some ice maker disinfection devices 180 comprise one or more UV-C and or UV-V lamps to emit high-energy ultraviolet radiation that creates cold oxygen plasma or UV photoplasma, which reduces microbes and bacteria on internal ice maker surfaces. Other ice maker disinfection devices can use a corona discharge electrode to produce high-voltage electrical discharge that generates ozone, which likewise reacts with organic matter to reduce microbes and bacteria on internal ice maker surfaces. The controller 160 is operatively connected to the ice maker disinfection device 180 to activate and deactivate the disinfection device on command.

In the illustrated embodiment, the ice maker safety subsystem includes a natural gas sensor 182 located in the cabinet 104 and configured to detect flammable natural gas and output a detection signal indicating detection of natural gas. Suitably, the gas sensor 182 may be a special-purpose gas sensor calibrated specifically for detecting the type of flammable refrigerant with which the ice maker's refrigeration system is charged. General purpose hydrocarbon flammable gas sensors can also be used without departing from the scope of the disclosure. The gas sensor 182 is operatively connected to the controller 160 for transmitting the detection signal to the controller. In one or more embodiments, the gas sensor 182 only signals the controller 160 when it detects an unsafe concentration of flammable refrigerant gas inside the cabinet 104 (e.g., an amount of flammable gas in excess of 50% of the Lower Explosive or Flammability Limit ("LEL/LFL") below which ignition cannot occur; for propane the LEL/LFL 2.1% by volume or 21,000 ppm). This type of gas sensor 182 may be called a safety switch. In other embodiments, the gas sensor 182 continuously or periodically signals the controller 160 with a measurement of the amount of detected flammable refrigerant in the interior of the cabinet 104.

Preferably, the gas sensor 182 is an always-on device. Accordingly, in one or more embodiments, the ice maker 103 can comprise a battery backup power system for powering a safety subsystem that includes the gas sensor 182, controller 160, and one or more output components used for taking action in response to a gas leak as will be described more fully below (e.g., the display 220 and/or the condenser fan 115). Accordingly, when main power is lost, the safety subsystem can continue to function to detect and act on refrigerant gas leaks.

Any suitable type of natural gas sensor 182 may be used without departing from the scope of the disclosure. In one or more embodiments, the sensor 182 can comprise an infrared gas detector. An infrared gas detector comprises an infrared light, an optical filter to select the proper wavelength of light, and an infrared receiver spaced apart from the infrared light. Gas in the space between the infrared light and receiver absorbs some of the infrared energy. Flammable natural gasses like r290 refrigerant absorbs more infrared energy than ambient air. Thus, the receiver can detect the presence of flammable gas as a drop in received energy at the receiver and outputs a signal to the controller 160 indicating the presence of flammable refrigerant in the cabinet 104.

In other embodiments, the gas sensor 182 can comprise a semiconductor gas detector. Semiconductor gas detectors utilize a thin layer of material that reacts with the flammable refrigerant gas, which causes a change in the electrical conductivity of the sensor. When a change in conductivity occurs, the gas detector can signal the controller 160 to indicate the presence of flammable refrigerant inside the cabinet 104.

In another embodiment, the gas sensor 182 comprises one or more lower explosive limit ("LEL") gas sensors. LEL gas sensors use a sensing element coated with a catalyst material that releases heat in the presence of the flammable gas. To measure this heat release, the sensor includes a Wheatstone bridge circuit, whose resistance varies with the heat released from the sensing element. LEL sensors are typically low resolution across a range of gas concentration. So instead of providing a measurement output signal that varies with gas concentration, they are configured as safety switches calibrated to output a signal when a certain threshold concentration of gas is present, usually a fractional percentage of the LEL for the flammable gas, e.g., 25% LEL.

In still other embodiments, the gas sensor 182 can comprise a Phot Ionization Detector. A Photo Ionization Detector (PID) is a gas detection device that uses ultraviolet light to ionize gas molecules in a sample. The ionization process produces ions (e.g., electrons), which are then detected by the device's sensor. The number of ions produced is directly proportional to the concentration of the flammable gas in the sample, allowing for accurate measurement of gas concentration levels, and providing an output signal that varies with gas concentration across a substantial measurement range.

This disclosure now provides a general overview of how the ice maker 103 is used to make and harvest ice during normal use, before describing its processes for responding to refrigerant leaks to mitigate against fires and explosions. During typical use, the controller 160 is generally configured to conduct consecutive ice batch production cycles. Each ice batch production cycle comprises steps of freezing the ice (a freeze step), harvesting the ice (a harvest step), and filling the sump 130 (a fill step). At least some of the ice batch production cycles comprise steps of purging hard water from the sump 130 after a batch of ice is formed and before the sump is refilled (a purge step).

An exemplary embodiment of a typical ice batch production cycle will now be briefly described. During the freeze step, the refrigeration system is operated to cool the freeze plate 110. At the same time, the pump 132 circulates water from the sump 130 through the water line 134 and further through the distributor 146. The distributor 146 distributes water along the top portion of the freeze plate 110. As the water flows down the front of the freeze plate 110, some of the water freezes into ice, forming ice pieces on the freeze plate of gradually increasing thickness. The unfrozen water falls off of the freeze plate 110 back into the sump 130.

When the ice reaches a thickness that is suitable for harvesting, the controller 160 switches from the freeze step to the ice harvest step. The pump 132 is turned off and the hot gas valve 124 is opened to redirect hot refrigerant gas to the evaporator 120. The hot gas warms the freeze plate 110, causing the ice to melt. The melting ice falls from the freeze plate into an ice bin (not shown) below. The hot gas valve 124 is closed after the ice has fallen from the freeze plate, as indicated by the harvest sensor 166.

Before beginning another ice batch production cycle, the sump 130 must be refilled. The sump has an end-of-circulation water level that is less than an ice making water level at which the ice maker begins each ice batch production cycle. Thus, before beginning a subsequent freeze step, the controller 160 opens the water inlet valve 140 to let new supply water into the sump 130. The water filter 147 filters the water imparted into the sump. The controller 160 closes the water inlet valve 140 when the water level sensor 136 provides an indication to the controller that the water level in the sump 130 reaches the ice making water level. As explained more fully below, in the illustrated embodiment, the controller 160 is configured to monitor the amount of time that the water inlet valve 140 is open in order to fill the sump 130 to the ice making water level.

At least periodically, it is beneficial to purge a portion of the water from the sump 130 before beginning a new ice production cycle. This is advantageous because, during the freeze step, as the water flows down the front of the freeze plate 110, impurities in the water such as calcium and other minerals in solution will remain in solution with the liquid water as purer water freezes. Thus, during each freeze step, the concentration of impurities in the water will increase. Excessive concentrations of impurities can quickly degrade the performance of the ice maker and even render it inoperable. Thus, periodically, the controller 160 will conduct a purge step before the fill step by opening the drain valve 144 to purge a portion of the residual water from the sump 130 from the end-of-circulation water level to a purge threshold water level. The drain valve 144 is one suitable type of purge mechanism but other types of purge mechanisms (e.g., active drain pumps) can also be used to execute the above-described purge step without departing from the scope of the disclosure. In an exemplary embodiment, the user interface device 220 enables a user to selectively set the frequency of purge cycles and/or to set the purge threshold water level for the ice maker 103.

Figure 5:
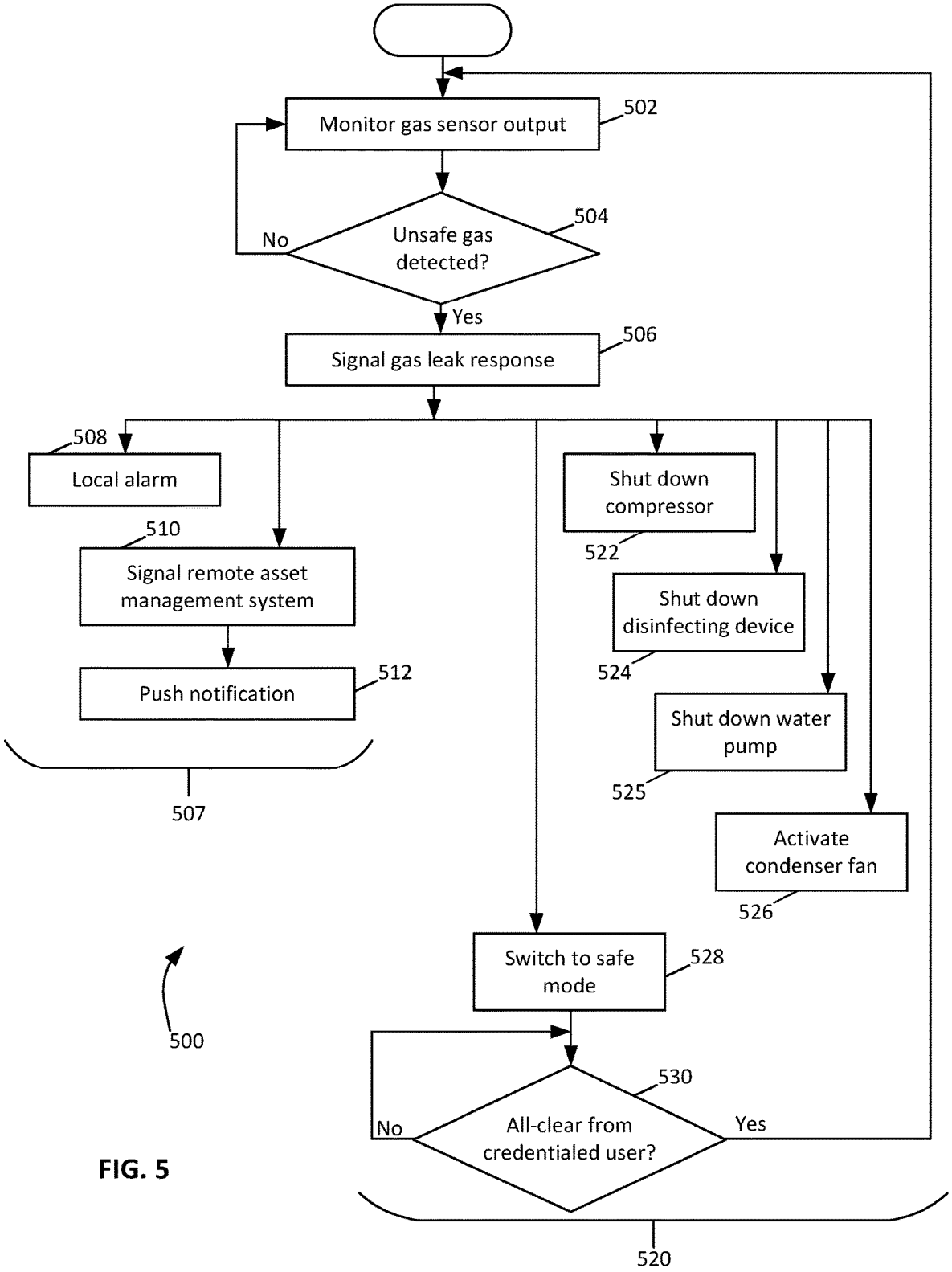
FIG. 5 is a flow chart illustrating the steps and decision points of an exemplary method of responding to a refrigerant leak in accordance with the present disclosure.

Referring now to FIG. 5, an exemplary method of responding to a refrigerant leak is generally indicated at reference number 500. At an initial step 502, the controller 160 monitors the output from the gas sensor 182. At decision point 504, the controller 160 determines whether the output from the gas sensor 182 indicates an unsafe amount of flammable refrigerant inside the cabinet. If no, the controller continues to monitor the output from the gas sensor 182 (step 502). If yes, at step 506 the controller 160 outputs a response signal operative to initiate a gas leak response action. As mentioned above, the gas sensor 182 can be configured to only signal the controller when an unsafe amount of flammable refrigerant is detected or to continuously or periodically signal the controller with measurements of the amount of flammable gas detected inside the cabinet. In the latter case, at decision point 504, the controller 160 determines whether the measured amount of flammable refrigerant exceeds a predetermined safety threshold (e.g., a threshold in an inclusive range between 1% and 50% of the LEL/LFL) and proceeds to step 506 when the measured amount of flammable refrigerant exceeds the safety threshold. (Control parameters like the safety threshold are suitably stored in a register of the controller memory 164).

In the illustrated embodiment, the controller's output in step 506 initiates several gas leak response actions in parallel. One aspect of the response comprises an alarm and notification subroutine 507, which includes a step 508 at which the controller 160 generates a local alarm indication at the ice maker 103. This local alarm indication can suitability be displayed on the display 220 and/or be generated audibly via a buzzer or other speaker device. In parallel, at step 510, the controller 160 uses the network interface 170 to signal the remote asset management system 105 that a potentially unsafe refrigerant leak has been detected. In response, at step 512, the asset management system 105 pushes a notification to the ice maker operator so that the ice maker operator is made aware of the potentially unsafe situation in real time.

In parallel with the alarm and notification subroutine, the controller conducts a shutdown and exhaust subroutine 520. In this subroutine, the controller 160 automatically shuts down the sparking components of the ice maker 103 so that the flammable refrigerant is not ignited. For example, at step 522, the controller 160 shuts off the compressor 112; at step 524, the controller shuts off the disinfecting device 180; and at step 525, the controller shuts off the water pump 132. Shutting off the compressor 112 serves a second purpose in addition to mitigating against ignition. It also stops the compression of refrigerant within the refrigeration system, which may slow the rate of leakage.

The shutdown and exhaust subroutine 520 further comprises a step 526 of activating the condenser fan 115 to exhaust the cabinet 104 through the grill 106. Even with higher charges of flammable refrigerants on the order of 500 g, the total amount of flammable refrigerant in the system does not present a flammability risk when diluted into the full volume of air in the typical room in which the ice maker 103 is deployed. Thus, by exhausting the cabinet 104, the leaking flammable gas is diluted to a safe concentration. In one or more embodiments, at step 526 the controller 160 operates the condenser fan 115 to continuously exhaust the cabinet 104 at least until the gas sensor 182 no longer detects an unsafe concentration of flammable refrigerant gas. In certain embodiments, step 526 comprises operating the condenser fan 115 until the gas sensor 182 no longer detects an unsafe concentration of flammable refrigerant gas and then continuing to operate the condenser fan 115 to exhaust the cabinet 104 for a predetermined interval of time (e.g., five more minutes).

Unlike refrigerators and freezers that have sealed interior spaces, the inside of the ice maker cabinet 104 is in communication with the ambient environment. Accordingly, it is not necessary to equip the ice maker 103 with an additional exhaust fan and closeable exhaust duct. Although the inventor believes that the condenser fan 115 can adequately exhaust the cabinet 104 without a supplemental exhaust system, it is contemplated that an additional supplemental exhaust fan can also be included without departing from the scope of the disclosure. The inventor contemplates that the supplemental exhaust fan could operate in tandem with the condenser fan 115 during the shutdown and exhaust subroutine 520. Although in some cases (e.g., where the condenser fan 115 is not non-sparking and the supplemental exhaust fan is non-sparking) it may be desirable to operate the supplemental exhaust fan in lieu of the condenser fan. Referring to FIG. 2, when a supplemental exhaust fan is included, it may be beneficial to locate the supplemental exhaust fan at a location SEFL1 immediately behind the grill 106 and/or at another location SEFL2 in an opening in a wall of the cabinet away from the condenser fan 115.

The shutdown and exhaust subroutine 520 further comprises a step 528 of switching the ice maker 103 to a "safe mode." In one or more embodiments, during safe mode operation, the controller 160 prevents the compressor 112 from operating normally until it receives an input from a credentialed user (e.g., a certified appliance servicing technician) that the refrigeration system is safe to use. See decision point 530. For example, in one or more embodiments, a credentialed user must enter a password to the user interface device 220, in order to make an input confirming that it is safe to resume normal ice maker operations and allowing the ice maker to return to normal operation.

Figure 6:
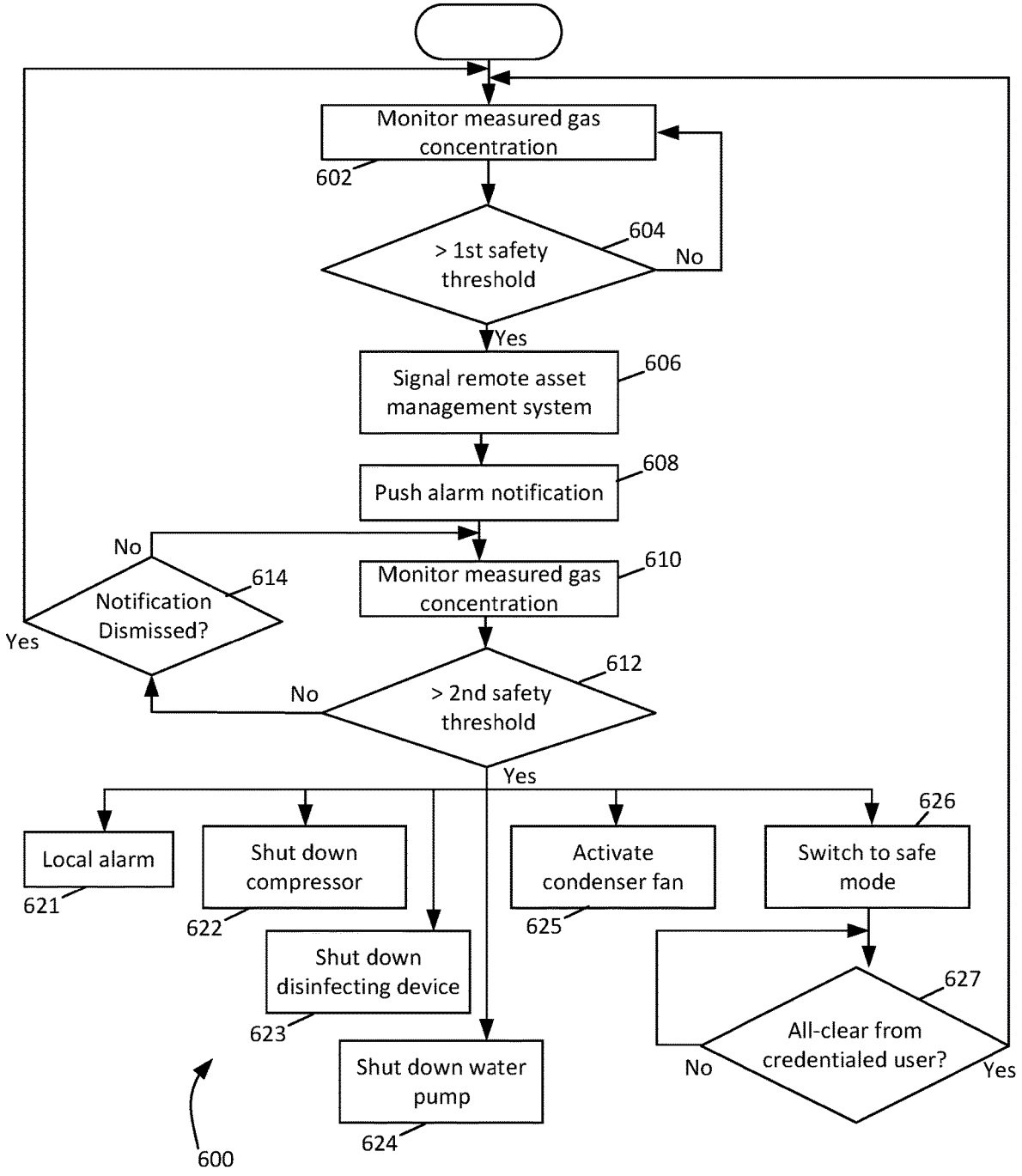
FIG. 6 is another flow chart illustrating the steps and decision points of an exemplary method of responding to a refrigerant leak.

Referring to FIG. 6, another exemplary method of responding to a refrigerant leak is generally indicated at reference number 600. The method 600 is similar to the method 500 except that it employs a two-stage response to detection of leaking flammable gas. That is, in the method 600, the controller first determines when the concentration of flammable refrigerant in the ice maker cabinet 104 exceeds a first threshold and takes first responsive action, and second, determines when the concentration of flammable refrigerant in the ice maker cabinet exceeds a greater second threshold and takes second responsive action. To facilitate the two-stage response, the gas sensor 182 can comprise a device that outputs a signal that varies with measured concentration of flammable refrigerant gas inside the cabinet 104. Alternatively, the gas sensor can comprise first and second safety switches, wherein the first safety switch is calibrated to output a detection signal to the controller 160 when the concentration of flammable gas inside the cabinet 104 exceeds the first threshold and the second safety switch is calibrated to output a detection signal to the controller when the concentration of flammable gas inside the cabinet 104 exceeds the greater second threshold.

At an initial step 602, the controller 160 monitors the output from the gas sensor 182. At decision point 604, the controller 160 determines whether the output from the gas sensor 182 indicates that there is a concentration of flammable refrigerant gas inside the ice maker cabinet 104 in excess of the first (lower) safety threshold. In one or more embodiments, the first safety threshold is in an inclusive range of from about 1% to about 25% of the LEL/LFL for the refrigerant (e.g., in an inclusive range from about 10% to about 25% of the LEL/LFL). For instance, in one embodiment the first safety threshold is about 10% of the LEL/LFL for the flammable refrigerant gas. In another embodiment, the LEL/LFL is about 25% of the LEL/LFL for the flammable refrigerant gas.

If there is no detection of a concentration of flammable refrigerant in excess of the first safety threshold, the controller 160 continues to monitor the output from the gas sensor 182 (step 602). When the controller 160 receives indication from the gas sensor 182 that the concentration of flammable refrigerant inside the cabinet 104 exceeds the first safety threshold, at step 606, the controller 160 uses the network interface 170 to signal the remote asset management system 105 that a potentially unsafe refrigerant leak has been detected. In response, at step 608, the asset management system 105 pushes a notification to the ice maker operator so that the ice maker operator is made aware of the potentially unsafe situation in real time.

Subsequently, in step 610, the controller 160 continues to monitor the output from the gas sensor 182 in order to determine, at decision point 612, whether the concentration of flammable refrigerant in the ice maker cabinet 104 exceeds the greater second safety threshold. The second safety threshold is greater than the first safety threshold. In one or more embodiments, the second safety threshold is in an inclusive range of from about 25% to about 55% of the LEL/LFL for the refrigerant (e.g., in an inclusive range from about 25% to about 50% of the LEL/LFL). For instance, in one embodiment the first safety threshold is about 25% of the LEL/LFL. In another embodiment, the LEL/LFL is about 40% of the LEL/LFL.

If the output from the gas sensor 182 never indicates a further increase in the concentration of flammable refrigerant to the second safety threshold and the ice maker 103 continues to function normally, it may be that the detection of gas in excess of the first safety threshold was due to a transient condition unrelated to a refrigerant leak from the ice maker's refrigeration system. Accordingly, the illustrated method 600 includes a decision point 614 at which the controller determines whether the operator has made an input (e.g., via the user interface 220 or the remote asset management system 105) dismissing the alarm notification.

When an authorized input dismissing the alarm notification is received, the controller 160 returns to step 602 of the method 600.

But when at decision point 612 the controller 160 receives a signal from the gas sensor 182 indicating that the concentration of flammable refrigerant gas inside the cabinet 104 exceeds the second safety threshold, the controller 160 conducts a second-stage refrigerant leak response procedure. In the illustrated embodiment, the second stage refrigerant leak response procedure includes a step 621 at which the controller 160 generates a local alarm indication at the ice maker 103. In parallel, at steps 622, 623, and 624, the controller 160 shuts off the compressor 112, the disinfecting device 180, and the water pump 132. At step 625 of the second-stage response procedure, the controller 160 activates the condenser fan 115 (and/or a supplemental exhaust fan) to exhaust the cabinet 104 through the grill 106. As above, the controller 160 can operate the fan(s) continuously until the gas sensor 182 no longer detects an unsafe concentration of flammable refrigerant gas, and optionally, then continue to operate the condenser fan 115 to exhaust the cabinet 104 for a predetermined interval of time (e.g., five more minutes). The second-stage response procedure further comprises a step 626 of switching the ice maker 103 to the safe mode until it receives an input from a credentialed user (e.g., a certified appliance servicing technician) that the refrigeration system is safe to use. See decision point 627.

As can be seen, this disclosure provides a system and method for responding to flammable refrigerant leaks in ice makers. Due to restrictive charge limitations on flammable refrigerants, and due to the fact that there is no sealed-off space containing refrigeration in an ice maker 103 (contra refrigerators and freezers), heretofore, there has not been a serious risk of fires from using flammable refrigerants in ice makers. However, greater charge limits come with greater fire risk. The inventor believes that the above-described systems and methods for responding to flammable refrigerant leaks can further mitigate the risk of fires, even as greater charges of flammable refrigerants are used in future generations of ice makers.

Embodiments of the present disclosure may comprise a special purpose computer including a variety of computer hardware, as described in greater detail herein.

For purposes of illustration, programs and other executable program components may be shown as discrete blocks. It is recognized, however, that such programs and components reside at various times in different storage components of a computing device, and are executed by a data processor(s) of the device.

Although described in connection with an example computing system environment, embodiments of the aspects of the invention are operational with other special purpose computing system environments or configurations. The computing system environment is not intended to suggest any limitation as to the scope of use or functionality of any aspect of the invention. Moreover, the computing system environment should not be interpreted as having any dependency or requirement relating to any one or combination of components illustrated in the example operating environment. Examples of computing systems, environments, and/or configurations that may be suitable for use with aspects of the invention include, but are not limited to, personal computers, server computers, hand-held or laptop devices, multiprocessor systems, microprocessor-based systems, set top boxes, programmable consumer electronics, mobile telephones, network PCs, minicomputers, mainframe computers, distributed computing environments that include any of the above systems or devices, and the like.

Embodiments of the aspects of the present disclosure may be described in the general context of data and/or processor-executable instructions, such as program modules, stored one or more tangible, non-transitory storage media and executed by one or more processors or other devices. Generally, program modules include, but are not limited to, routines, programs, objects, components, and data structures that perform particular tasks or implement particular abstract data types. Aspects of the present disclosure may also be practiced in distributed computing environments where tasks are performed by remote processing devices that are linked through a communications network. In a distributed computing environment, program modules may be located in both local and remote storage media including memory storage devices.

In operation, processors, computers and/or servers may execute the processor-executable instructions (e.g., software, firmware, and/or hardware) such as those illustrated herein to implement aspects of the invention.

Embodiments may be implemented with processor-executable instructions. The processor-executable instructions may be organized into one or more processor-executable components or modules on a tangible processor readable storage medium. Also, embodiments may be implemented with any number and organization of such components or modules. For example, aspects of the present disclosure are not limited to the specific processor-executable instructions or the specific components or modules illustrated in the figures and described herein. Other embodiments may include different processor-executable instructions or components having more or less functionality than illustrated and described herein.

The order of execution or performance of the operations in accordance with aspects of the present disclosure illustrated and described herein is not essential, unless otherwise specified. That is, the operations may be performed in any order, unless otherwise specified, and embodiments may include additional or fewer operations than those disclosed herein. For example, it is contemplated that executing or performing a particular operation before, contemporaneously with, or after another operation is within the scope of the invention.

When introducing elements of the invention or embodiments thereof, the articles "a," "an," "the," and "said" are intended to mean that there are one or more of the elements. The terms "comprising," "including," and "having" are intended to be inclusive and mean that there may be additional elements other than the listed elements.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively, or in addition, a component may be implemented by several components.

The above description illustrates embodiments by way of example and not by way of limitation. This description enables one skilled in the art to make and use aspects of the invention, and describes several embodiments, adaptations, variations, alternatives and uses of the aspects of the invention, including what is presently believed to be the best mode of carrying out the aspects of the invention. Additionally, it is to be understood that the aspects of the invention are not limited in its application to the details of construction and the arrangement of components set forth in the following description or illustrated in the drawings. The aspects of the invention are capable of other embodiments and of being practiced or carried out in various ways. Also, it will be understood that the phraseology and terminology used herein is for the purpose of description and should not be regarded as limiting.

It will be apparent that modifications and variations are possible without departing from the scope of the invention defined in the appended claims. As various changes could be made in the above constructions and methods without departing from the scope of the invention, it is intended that all matter contained in the above description and shown in the accompanying drawings shall be interpreted as illustrative and not in a limiting sense.

In view of the above, it will be seen that several advantages of the aspects of the invention are achieved and other advantageous results attained.

The Abstract and Summary are provided to help the reader quickly ascertain the nature of the technical disclosure. They are submitted with the understanding that they will not be used to interpret or limit the scope or meaning of the claims. The Summary is provided to introduce a selection of concepts in simplified form that are further described in the Detailed Description. The Summary is not intended to identify key features or essential features of the claimed subject matter, nor is it intended to be used as an aid in determining the claimed subject matter.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description shall be interpreted as illustrative and not in a limiting sense.

What is claimed is:

1. An ice maker comprising:

a cabinet having an interior and an exterior;

an ice formation device received in the cabinet;

a refrigeration system at least partially received in the cabinet for cooling the ice formation device, the refrigeration system comprising a compression-drive refrigeration system charged with flammable refrigerant;

a water system at least partially received in the cabinet for supplying water to the ice formation device; and a control system for operating the water system and the refrigeration system for cooling the ice formation device with the refrigeration system to form water supplied to the ice formation device by the water system into ice, the control system comprising:

a flammable refrigerant sensor in the cabinet configured to detect flammable refrigerant and output a detection signal indicating detection of the flammable refrigerant; and a controller connected to the flammable refrigerant sensor for receiving the detection signal, the controller configured to initiate a staged hazard response upon receiving the detection signal, the staged hazard response comprising:

a first response stage in which the controller, upon determining that a concentration of the flammable refrigerant inside the cabinet exceeds a first threshold, outputs a notification while the ice maker continues operating; and a second response stage in which the controller, upon determining that the concentration of the flammable refrigerant inside the cabinet exceeds a second threshold greater than the first threshold, initiates one or more mitigation actions including at least one of shutting off a sparking component of the ice maker, activating a fan to exhaust leaked refrigerant from the cabinet, or switching the ice maker to a safe operating mode.

2. The ice maker as set forth in claim 1, wherein the staged hazard response comprises generating an alarm indication.

3. The ice maker as set forth in claim 2, further comprising a network communication device, the controller configured to push the alarm notification to a remote user using the network communication device.

4. The ice maker as set forth in claim 2, wherein the controller is configured to generate the alarm indication locally at the ice maker.

5. The ice maker as set forth in claim 1, wherein the second response stage comprises deactivating one or more sparking components of the ice maker, the one or more sparking components including at least one of a compressor, a water pump, or an ozone disinfecting device.

6. The ice maker as set forth in claim 1, further comprising an ozone disinfecting device inside the cabinet, wherein the second response stage comprises deactivating the ozone disinfecting device.

7. The ice maker as set forth in claim 1, wherein the refrigeration system comprises a condenser fan, wherein the second response stage comprises running the condenser fan to exhaust leaked flammable refrigerant from the cabinet through a grill of the cabinet.

8. The ice maker as set forth in claim 7, wherein the condenser fan is spark-resistant.

9. The ice maker as set forth in claim 1, wherein the refrigeration system comprises a compressor, wherein the second response stage comprises deactivating the compressor.

10. The ice maker as set forth in claim 1, wherein the second response stage comprises switching the ice maker from a normal operating mode to a safe operating mode, wherein the safe operating mode prevents normal operation of the ice maker until the controller receives an input from a credentialed user confirming that the ice maker is safe to resume normal operation.

11. The ice maker as set forth in claim 1, wherein the second response stage comprises shutting off the ice maker.

12. The ice maker as set forth in claim 1, wherein no portion of the refrigeration system is located in a sealed-off space in the interior of the cabinet that is sealed off from the exterior of the cabinet.

13. The ice maker as set forth in claim 1, wherein the first response stage pushes a notification to an operator of the ice maker via a network communication device while the ice maker continues operating.

14. The ice maker as set forth in claim 1, further comprising an ozone disinfecting device inside the cabinet configured to generate ozone for disinfecting surfaces of the ice maker;

wherein:

during normal operation, the controller governs operation of ice-making cycles of the refrigeration system and the water system; and during the second response stage, the controller executes a coordinated hazard response that deactivates both the compressor of the refrigeration system and the ozone disinfecting device.

15. The ice maker as set forth in claim 1, wherein the refrigeration system comprises a condenser and a condenser fan and wherein:

during a normal operating mode, the controller operates the condenser fan to reject heat from the condenser; and during the second response stage, the controller operates the same condenser fan to exhaust leaked refrigerant from the cabinet through the grill.

16. The ice maker as set forth in claim 15, wherein during the normal operating mode the controller operates the condenser fan at a first speed and during the hazard mitigation mode the controller operates the condenser fan at a second speed greater than the first speed.

* * * * *